US010823470B2

(12) United States Patent
Wang

(10) Patent No.: US 10,823,470 B2
(45) Date of Patent: Nov. 3, 2020

(54) LIQUID ACCUMULATOR FOR HEAT EXCHANGE SYSTEM, REFRIGERATION SYSTEM HAVING THE SAME, CASCADE REFRIGERATION SYSTEM AND CONTROL METHOD THEREOF

(71) Applicant: Carrier Corporation, Palm Beach Gardens, FL (US)

(72) Inventor: Lufei Wang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 186 days.

(21) Appl. No.: 16/073,959

(22) PCT Filed: Jan. 23, 2017

(86) PCT No.: PCT/US2017/014536
§ 371 (c)(1),
(2) Date: Jul. 30, 2018

(87) PCT Pub. No.: WO2017/136174
PCT Pub. Date: Aug. 10, 2017

(65) Prior Publication Data

US 2019/0041108 A1 Feb. 7, 2019

(30) Foreign Application Priority Data

Feb. 3, 2016 (CN) ..... 2016 1 0075232

(51) Int. Cl.
*F25B 43/00* (2006.01)
*F25B 41/00* (2006.01)
(Continued)

(52) U.S. Cl.
CPC ..... *F25B 41/003* (2013.01); *F25B 43/006* (2013.01); *F25B 49/02* (2013.01);
(Continued)

(58) Field of Classification Search
CPC ..... F25B 43/006; F25B 40/04; F25B 43/02; F25B 2400/16
See application file for complete search history.

(56) References Cited

U.S. PATENT DOCUMENTS 2,749,723 A * 6/1956 Webber ..... F22B 37/265 62/470
3,088,292 A * 5/1963 Kocher ..... F25B 39/04 62/196.1
(Continued)

FOREIGN PATENT DOCUMENTS

CN 202216448 U 5/2012
CN 104321598 A 1/2015
(Continued)

OTHER PUBLICATIONS

International Search Report and Written Opinion for applicaiton PCT/US2017/014536, dated Apr. 4, 2017, 11 pages.
(Continued)

*Primary Examiner* — Frantz F Jules
*Assistant Examiner* — Lionel Nouketcha
(74) *Attorney, Agent, or Firm* — Cantor Colburn LLP

(57) ABSTRACT

A liquid accumulator for a heat exchange system, includes a liquid accumulator housing provided with an air inlet, an air outlet, and a liquid inlet; and a cooling heat exchanger disposed in the liquid accumulator housing, wherein the cooling heat exchanger comprises an inlet end, a main body part, and an outlet end in sequence; the inlet end of the cooling heat exchanger is connected to the air inlet on the liquid accumulator housing; and the outlet end of the cooling heat exchanger is arranged to be higher than a working liquid level of a refrigerant in the liquid accumulator.

24 Claims, 3 Drawing Sheets

(51) Int. Cl.
*F25B 49/02* (2006.01)
*F25B 9/00* (2006.01)
*F25B 40/04* (2006.01)

(52) U.S. Cl.
CPC ..... *F25B 9/008* (2013.01); *F25B 40/04* (2013.01); *F25B 2339/041* (2013.01); *F25B 2400/0415* (2013.01); *F25B 2400/05* (2013.01); *F25B 2400/053* (2013.01); *F25B 2400/16* (2013.01); *F25B 2600/2501* (2013.01); *F25B 2700/21152* (2013.01)

(56) References Cited

U.S. PATENT DOCUMENTS

| | | | | |
|---|---|---|---|---|
| 3,212,289 | A * | 10/1965 | Bottum | F25B 43/006 62/468 |
| 3,633,377 | A * | 1/1972 | Quick | F25B 31/004 62/192 |
| 4,457,138 | A | 7/1984 | Bowman | |
| 4,711,094 | A | 12/1987 | Ares et al. | |
| 4,964,279 | A | 10/1990 | Osborne | |
| 5,170,639 | A | 12/1992 | Datta | |
| 5,377,501 | A * | 1/1995 | Muston | F25B 40/00 55/421 |
| 5,411,078 | A | 5/1995 | Ares | |
| 5,575,158 | A | 11/1996 | Vogel | |
| 5,899,091 | A * | 5/1999 | Fraser, Jr. | F25B 31/002 62/473 |
| 6,467,300 | B1 * | 10/2002 | Noble, III | F25B 40/00 62/472 |
| 9,003,818 | B2 | 4/2015 | Choi et al. | |
| 2008/0223074 | A1 | 9/2008 | Pachai et al. | |
| 2013/0091891 | A1 | 4/2013 | Hinde et al. | |
| 2014/0013790 | A1 | 1/2014 | Asari et al. | |
| 2014/0090407 | A1 * | 4/2014 | Piesker | F25B 43/006 62/119 |
| 2015/0345835 | A1 | 12/2015 | Martin et al. | |

FOREIGN PATENT DOCUMENTS

| | | | |
|---|---|---|---|
| CN | 104457053 | A | 3/2015 |
| DE | 102011014943 | A1 | 9/2012 |
| EP | 0402131 | A2 | 12/1990 |
| EP | 2530409 | A2 | 12/2012 |
| EP | 2940410 | A1 | 11/2015 |
| JP | H07127934 | A | 5/1995 |
| WO | 2006091190 | A1 | 8/2006 |
| WO | 2008017130 | A1 | 2/2008 |
| WO | 2012012491 | A2 | 1/2012 |

OTHER PUBLICATIONS

Chinese Office Action for application CN 201610075232.2, dated Apr. 8, 2020, 6 pages.

* cited by examiner

LIQUID ACCUMULATOR FOR HEAT EXCHANGE SYSTEM, REFRIGERATION SYSTEM HAVING THE SAME, CASCADE REFRIGERATION SYSTEM AND CONTROL METHOD THEREOF

TECHNICAL FIELD

The present invention relates to an improvement on a refrigeration system, and more particularly, to an improvement on parts and components of a refrigeration system and a corresponding control method.

BACKGROUND ART

A cascade refrigeration system is a type of refrigeration system commonly seen in industrial applications or large-scale commercial applications. The cascade refrigeration system generally consists of two independent refrigeration systems, that is, a high temperature stage part and a low temperature stage part. The high temperature stage part may use a medium-temperature refrigerant, while the low temperature stage may use a low-temperature refrigerant. During running of the system, the refrigerant in the high temperature stage part is evaporated to condense the refrigerant in the low temperature stage part, and the two systems are connected via a condensing evaporator that is connected into the both refrigeration systems at the same time. This condensing evaporator not only functions as an evaporator in the high temperature stage part but also functions as a condenser in the low temperature stage part. The refrigerant in the low temperature stage part absorbs heat from a cooled object in the evaporator (that is, prepares a refrigerating capacity) and transfers the heat to the refrigerant in the high temperature stage part, and then the refrigerant in the high temperature stage part transfers the heat to a cooling medium (water or air).

FIG. 1 herein shows a cascade refrigeration system 100 which uses R134a as a medium-temperature refrigerant and uses CO2 as a low-temperature refrigerant. The system includes a compressor 120, an evaporative condenser 130, and a user terminal 140 that are sequentially connected, and further includes a liquid accumulator 110. An outlet end of the compressor 120 is connected to an air inlet of the liquid accumulator 110, and is connected to an inlet end of a condensation part of the evaporative condenser 130 through an air outlet of the liquid accumulator 110; an outlet end of the condensation part of the evaporative condenser 130 is separately connected to the user terminal 140 and a liquid inlet of the liquid accumulator 110. In the working process, the refrigerant that finishes cooling at the user terminal 140 returns to the compressor 120; the compressed refrigerant enters the liquid accumulator 110 and exchanges heat with the liquid refrigerant therein, to be cooled in certain degree; the refrigerant after cooled in certain degree flows into the condensation part of the evaporative condenser 130 from the liquid accumulator 110, and exchanges heat with an evaporation part of the evaporative condenser 130, to be further cooled. After that, most of the refrigerant flows into the user terminal 140 again for cooling; and meanwhile, the remaining liquid refrigerant returns to and accumulates in the liquid accumulator 110, to primarily cool the gaseous refrigerant that enters the liquid accumulator 110 via the compressor 120. However, although FIG. 1 is shown as an example, like other conventional cascade refrigeration systems 100 in the prior art, it also has several technical problems that have not been overcome. For example, the gaseous refrigerant is cooled in a very limited degree in such liquid accumulator 110 in the prior art, and this may result in an extremely high and extremely unstable cascade heat exchange temperature difference (for example, it is even as high as 50 K) between the refrigerant in the condensation part of the evaporative condenser 130 and the refrigerant in the evaporation part of the evaporative condenser 130, which will cause a damage to the evaporative condenser. Specifically, considering that brazing is generally used in manufacture of the evaporative condenser, for such a manufacturing process, if a working temperature difference therein is over 40 K in a long term and fluctuates frequently, it may quickly cause fatigue aging and damages to external and internal welds of the evaporative condenser, thus affecting the overall service life and performance of the equipment.

SUMMARY OF THE INVENTION

An objective of the present invention is to provide a liquid accumulator that can sufficiently cool a gaseous refrigerant entering therein.

Another objective of the present invention is to provide a refrigeration system that has a relatively low difference between temperature of the refrigerant on both sides of a condenser.

Another objective of the present invention is to provide a cascade refrigeration system that has a relatively low refrigerant temperature difference between an evaporation part and a condensation part of an evaporative condenser.

Another objective of the present invention is to provide a control method that can control a refrigerant temperature at an inlet end of a condenser.

Another objective of the present invention is to provide another control method that can adjust and control a refrigerant temperature at an inlet end of a condenser.

In order to achieve the foregoing objectives or other objectives, the present invention provides the following technical solutions.

According to an aspect of the present invention, a liquid accumulator for a heat exchange system is provided, including a liquid accumulator housing provided with an air inlet, an air outlet, and a liquid inlet; and a cooling heat exchanger disposed in the liquid accumulator housing, where the cooling heat exchanger includes an inlet end, a main body part, and an outlet end in sequence; the inlet end of the cooling heat exchanger is connected to the air inlet on the liquid accumulator housing; and the outlet end of the cooling heat exchanger is arranged to be higher than a working liquid level of a refrigerant in the liquid accumulator.

According to another aspect of the present invention, a refrigeration system is further provided, including the liquid accumulator as described above; and a compressor, a condenser, a throttling element, and an evaporator that are sequentially connected through a pipeline, where an outlet end of the compressor is connected to the air inlet of the liquid accumulator, and is connected to an inlet end of the condenser through the air outlet of the liquid accumulator, while an outlet end of the condenser is separately connected to the throttling element and the liquid inlet of the liquid accumulator.

According to still another aspect of the present invention, a cascade refrigeration system is further provided, including the liquid accumulator as described above; and a compressor, an evaporative condenser having an evaporation part and a condensation part that exchange heat with each other, a throttling element, and an evaporator that are sequentially connected through a pipeline, where an outlet end of the compressor is connected to the air inlet of the liquid accumulator, and is connected to an inlet end of the condensation part of the evaporative condenser through the air outlet of the liquid accumulator, while an outlet end of the condensation part of the evaporative condenser is separately connected to the throttling element and the liquid inlet of the liquid accumulator.

According to yet another aspect of the present invention, a control method of a cascade refrigeration system is further provided, where the refrigeration system as described above is included, and a desired working temperature of a refrigerant at the inlet end of the condensation part of the evaporative condenser is preset as a first threshold, the method including: closing a bypass valve on the bypass branch when the temperature detected by the temperature sensor is not lower than the first threshold; or opening the bypass valve on the bypass branch when the detected temperature is lower than the first threshold.

According to further another aspect of the present invention, a control method of a cascade refrigeration system is further provided, where the refrigeration system as described above is included, and a desired working temperature of a refrigerant at the inlet end of the condensation part of the evaporative condenser is preset as a first threshold, the method including: reducing an opening degree of a bypass valve on the bypass branch when the temperature detected by the temperature sensor is not lower than the first threshold, where a change in the opening degree of the bypass valve is linearly correlated to a difference between the detected temperature and the first threshold; or increasing an opening degree of the bypass valve on the bypass branch when the detected temperature is lower than the first threshold, where a change in the opening degree of the bypass valve is linearly correlated to a difference between the detected temperature and the first threshold.

DETAILED DESCRIPTION

Figure 1:
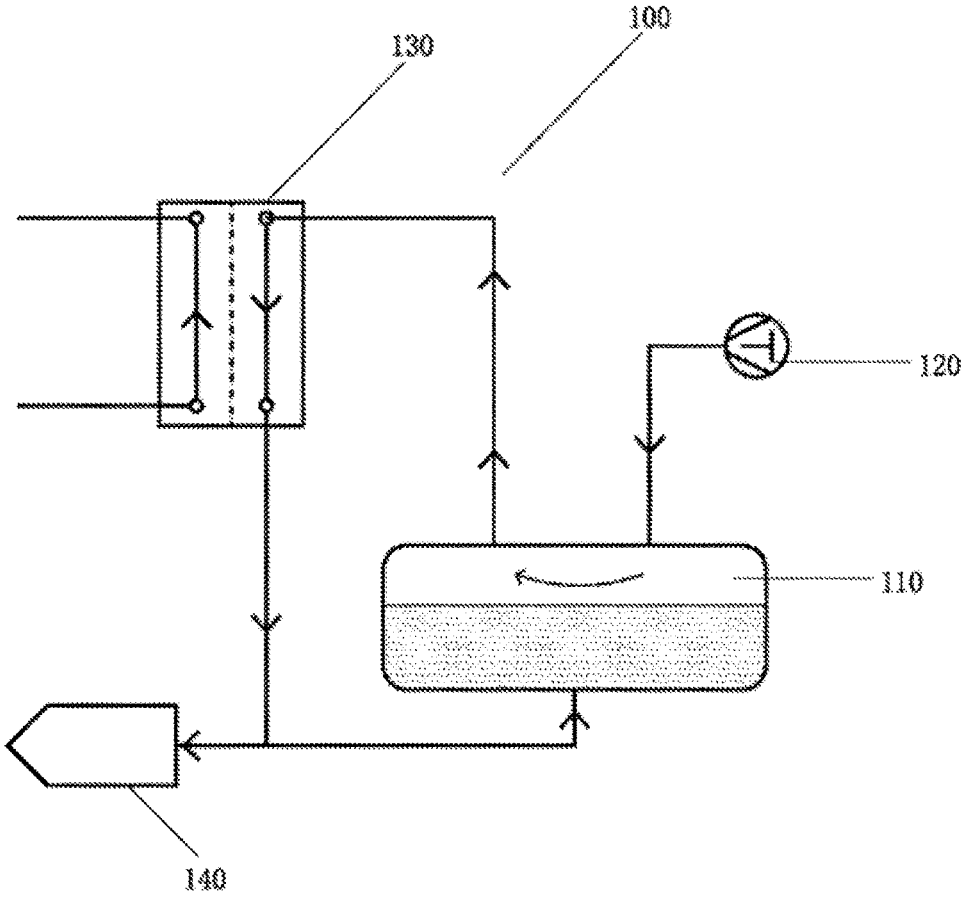
FIG. 1 is a schematic diagram of a cascade refrigeration system in the prior art.
Figure 2:
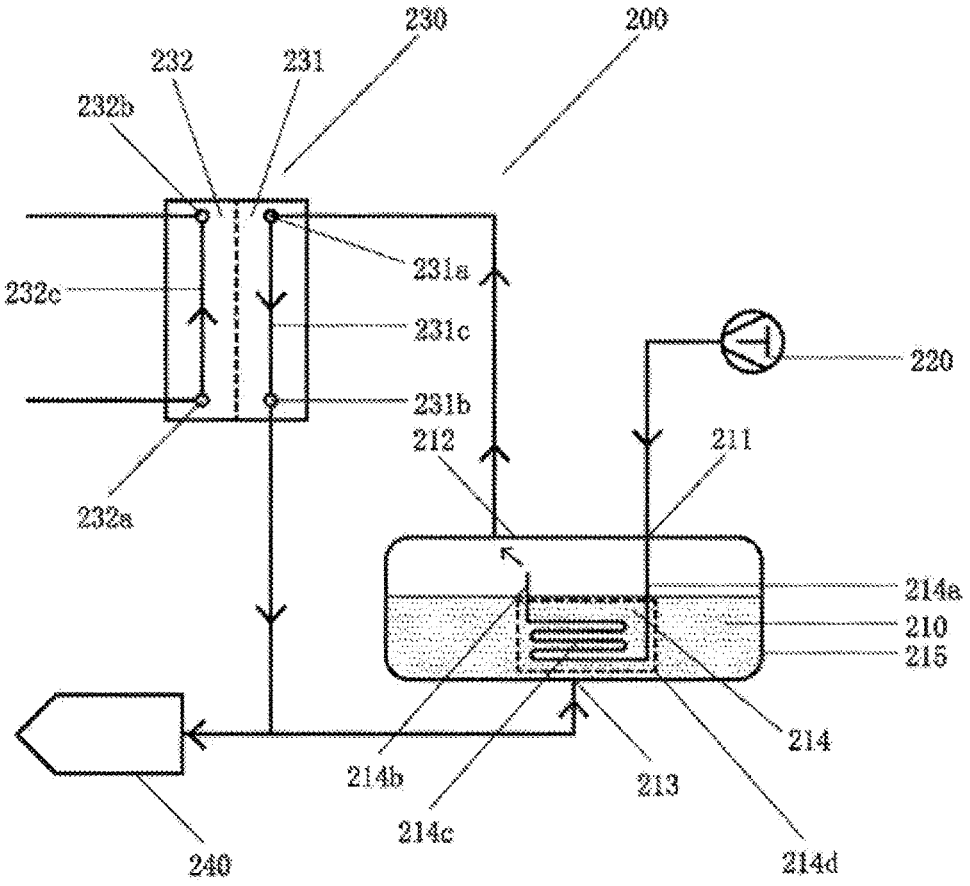
FIG. 2 is a schematic diagram of an embodiment of a cascade refrigeration system according to the present invention.

Referring to FIG. 2, it shows a cascade refrigeration system 200, and specifically includes an embodiment of a liquid accumulator 210 in the present invention. The liquid accumulator 210 includes a liquid accumulator housing 215 that has a cylindrical structure and is provided with an air inlet 211, an air outlet 212, and a liquid inlet 213. In addition, a cooling heat exchanger 214 is additionally disposed inside the liquid accumulator housing 215. With such a design, a high-temperature gaseous refrigerant that enters the liquid accumulator 210 can fully exchange heat with a low-temperature liquid refrigerant in the liquid accumulator 210 under the guidance of the cooling heat exchanger 214, so that the refrigerant is sufficiently cooled before leaving the liquid accumulator, and can be further cooled in a downstream evaporative condenser. In this way, the performance of the refrigeration system is guaranteed on one hand, and on the other hand, the workload of the downstream evaporative condenser thereof is also reduced, thus significantly improving its service life.

Specifically, the cooling heat exchanger 214 includes an inlet end 214*a*, a main body part 214*c*, and an outlet end 214*b* in sequence. The inlet end 214*a* of the cooling heat exchanger 214 is connected to the air inlet 211 on the liquid accumulator housing 215; and the outlet end 214*b* of the cooling heat exchanger 214 is arranged to be higher than a working liquid level of a refrigerant in the liquid accumulator 210. Such an arrangement can not only ensure that the high-temperature gaseous refrigerant flowing through the cooling heat exchanger 214 can exchange heat with the low-temperature liquid refrigerant accumulated in the liquid accumulator housing 215 but also avoid the possibility that the low-temperature liquid refrigerant accumulated in the liquid accumulator housing 215 flows into the cooling heat exchanger 214. Herein, it should be noted that, the working liquid level of the refrigerant in the liquid accumulator housing 125 in an actual running state may fluctuate in certain degree. In this case, persons skilled in the art may consider the specific design of the working liquid level of the refrigerant according to an actual design requirement. For example, in a general case, the working liquid level of the refrigerant here may be equivalent to a rated design working liquid level; for another example, in a working condition where extreme cases occur frequently, the working liquid level of the refrigerant here may also be equivalent to a possible maximum working liquid level.

Based on the above description of the working principle, several details of this design may also be further improved.

For example, when the cooling heat exchanger 214 is disposed in the liquid accumulator 210, it may be considered to make the main body part 214*c* of the cooling heat exchanger at least partially submerged in the refrigerant in the liquid accumulator 210 when the liquid accumulator 210 works. In this way, a requirement on design precision of the arrangement position of the cooling heat exchanger 214 is relatively low, the design is less difficult, and the objective of improving the heat exchange effect between the high-temperature gaseous refrigerant and the low-temperature liquid refrigerant can also be achieved.

For another example, the main body part 214*c* of the cooling heat exchanger 214 may also be completely submerged in the refrigerant in the liquid accumulator 210 when the liquid accumulator 210 works. In this way, the high-temperature gaseous refrigerant can exchange heat with the low-temperature liquid refrigerant accumulated in the liquid accumulator 210 when flowing through the entire part of the main body part 214*c*. This will better achieve the objective of improving the heat exchange effect between the high-temperature gaseous refrigerant and the low-temperature liquid refrigerant.

Further, although the arrangement design of the cooling heat exchanger 214 carried out with the refrigerant as a reference has higher accuracy, as an actual liquid level of the refrigerant may be different from a rated condition, the actual application thereof is relatively difficult, and position adjustment may need to be performed for multiple times. Therefore, several arrangement manners of the cooling heat exchanger 214 which have fixed referential standards are also provided herein.

For example, the main body part 214*c* is at least partially arranged below a first height of the liquid accumulator 110; or the main body part 214*c* may also be at least partially arranged below a height corresponding to a first volume of the liquid accumulator 110. Here, a specific numerical value of the first height or first volume mentioned here may be determined according to a liquid level height or an accumulation volume that the refrigerant in an expected working state would reach. Such a case where the design parameter is specified will be more beneficial for the arrangement of the cooling heat exchanger 214, and the objective of improving heat exchange in the liquid accumulator can also be achieved. Further, the main body part 214*c* may be completely arranged below the first height of the liquid accumulator 110, or completely arranged below the height corresponding to the first volume of the liquid accumulator 110. In this way, the objective of improving the heat exchange effect between the high-temperature gaseous refrigerant and the low-temperature liquid refrigerant can be better achieved.

In addition, the position design of the outlet end 214*b* of the cooling heat exchanger 214 may also be further improved. For example, the outlet end 214*b* may be arranged close to the air outlet 212 on the liquid accumulator housing 215. This helps the gaseous refrigerant flow, via the air outlet 212 of the liquid accumulator, to the evaporative condenser 230 as quickly as possible to exchange heat after leaving the cooling heat exchanger 214.

For the model selection of the cooling heat exchanger 214, several specific heat exchangers are provided here for selection. In an implementation, the main body part 214*c* of the cooling heat exchanger may be constructed as a coiled tube-type heat exchanger circling in an encircling form; in another implementation, the main body part 214*c* of the cooling heat exchanger may be constructed as a finned heat exchanger in reciprocating arrangement. The above structures can both make the main body part 214*c* submerged in the liquid refrigerant as long as possible, thereby extending a passage and time for heat exchange between the high-temperature gaseous refrigerant that flows through the main body part 214*c* and the outside low-temperature liquid refrigerant, and therefore, the obtained cooling effect becomes better.

Though not shown in the figure, in the above situation, the main body part 214*c* of the cooling heat exchanger may further be connected to the bottom of the liquid accumulator housing through an end plate, to provide a firm connection between the cooling heat exchanger and the liquid accumulator.

As an alternative manner, the cooling heat exchanger 214 further includes a cooling heat exchanger housing 214*d*, and the main body part 214*c* may be arranged in the heat exchanger housing 214*d*. By arranging the entire cooling heat exchanger 214 in a housing, it can be more conveniently installed in the liquid accumulator. For example, the connection between the cooling heat exchanger 214 and the liquid accumulator 210 may be implemented by welding the heat exchanger housing 214*d* to an inner wall of the bottom of the liquid accumulator housing 215. Optionally, in this case, the cooling heat exchanger housing 214*d* and the liquid inlet on the liquid accumulator housing 214*d* should be arranged in a staggered manner.

For the entire liquid accumulator 210, in addition to the improvement on the cooling heat exchanger 214 therein, the liquid accumulator housing 215 thereof may also be improved. For example, the air inlet 211 and/or the air outlet 212 may be arranged at the top of the liquid accumulator housing 215. This will be more convenient for the gaseous refrigerant to flow out. Similarly, the liquid inlet 213 may also be arranged at the bottom of the liquid accumulator housing 215, and this will be more convenient for the liquid refrigerant to flow in. More specifically, in the actual application of such type of liquid accumulator, very likely, it cannot be ensured that the liquid accumulator is placed in a horizontal state. Therefore, the liquid inlet 213 may be arranged at a first position at the bottom of the liquid accumulator housing 215, so that when a tilt occurs in specific arrangement, the first position is located at the lowest position at the bottom of the liquid accumulator housing, and thus when the equipment stops running, the liquid refrigerant accumulated in the liquid accumulator can flow out.

The liquid accumulator according to the present invention improves, by means of the cooling heat exchanger arranged herein, the passage length and time for heat exchange between the high-temperature gaseous refrigerant from the compressor and the low-temperature liquid refrigerant from the evaporative condenser as much as possible, so that the high-temperature gaseous refrigerant from the compressor can be sufficiently cooled in the liquid accumulator.

Further referring to FIG. 2, as a whole, it shows an embodiment of a cascade refrigeration system. The cascade refrigeration system 200 includes a compressor 220, an evaporative condenser 230 having an evaporation part 232 and a condensation part 231 that exchange heat with each other, and a user terminal 240 that are sequentially connected through a pipeline. The user terminal 240 herein at least includes conventional components: a throttling element (e.g., an expansion valve, capillary tube, etc.) and an evaporator. Besides, an outlet end of the compressor is connected to an air inlet 211 of a liquid accumulator 210, and is connected to an inlet end 231*a* of the condensation part 231 of the evaporative condenser 230 through an air outlet 212 of the liquid accumulator 210, while an outlet end 231*b* of the condensation part 231 of the evaporative condenser 230 is separately connected to the user terminal 240 and a liquid inlet 213 of the liquid accumulator 210.

In a running process of the cascade refrigeration system, after being throttled and supplying cool in the user terminal 240, a low-temperature liquid refrigerant will return to the compressor 220; the compressed refrigerant enters the main body part 214*c* of the cooling heat exchanger via the air inlet 211 of the liquid accumulator 210 and the inlet end 214*a* of the cooling heat exchanger, and during flowing, exchanges heat with the low-temperature liquid refrigerant surrounding the main body part 214*c*, to be sufficiently cooled; the cooled refrigerant flows out via the outlet end 214*b* of the cooling heat exchanger and the air outlet 212 of the liquid accumulator 210, and flows into a heat exchange section 231*c* of the condensation part via the inlet end 231*a* of the condensation part 231 of the evaporative condenser 230; a medium-temperature liquid refrigerant therein will exchange heat with the low-temperature liquid refrigerant in the evaporation part 232 of the evaporative condenser 230, to be further cooled. The cooled refrigerant will flow out from the outlet end 231*b* of the condensation part. Most of the refrigerant will flow into the user terminal 240 again, to be throttled and to supply cool; meanwhile, the other part of the liquid refrigerant will return to and accumulate in the liquid accumulator 210, thus preliminarily cooling a high-temperature gaseous refrigerant that enters the liquid accumulator 210 via the compressor 220. In this process, the liquid accumulator 210 undertakes most part of cooling for the high-temperature gaseous refrigerant from the compressor 220, and in this way, the downstream evaporative condenser 230 only needs to bear less and stable condensation load, which greatly mitigates the fatigue use of the evaporative condenser 230, and improves the service life of the equipment while guaranteeing the system performance.

Further, in order to optimize the system and control process, an embodiment of a cascade refrigeration system having a temperature adjustment and control space is further provided.

Figure 3:
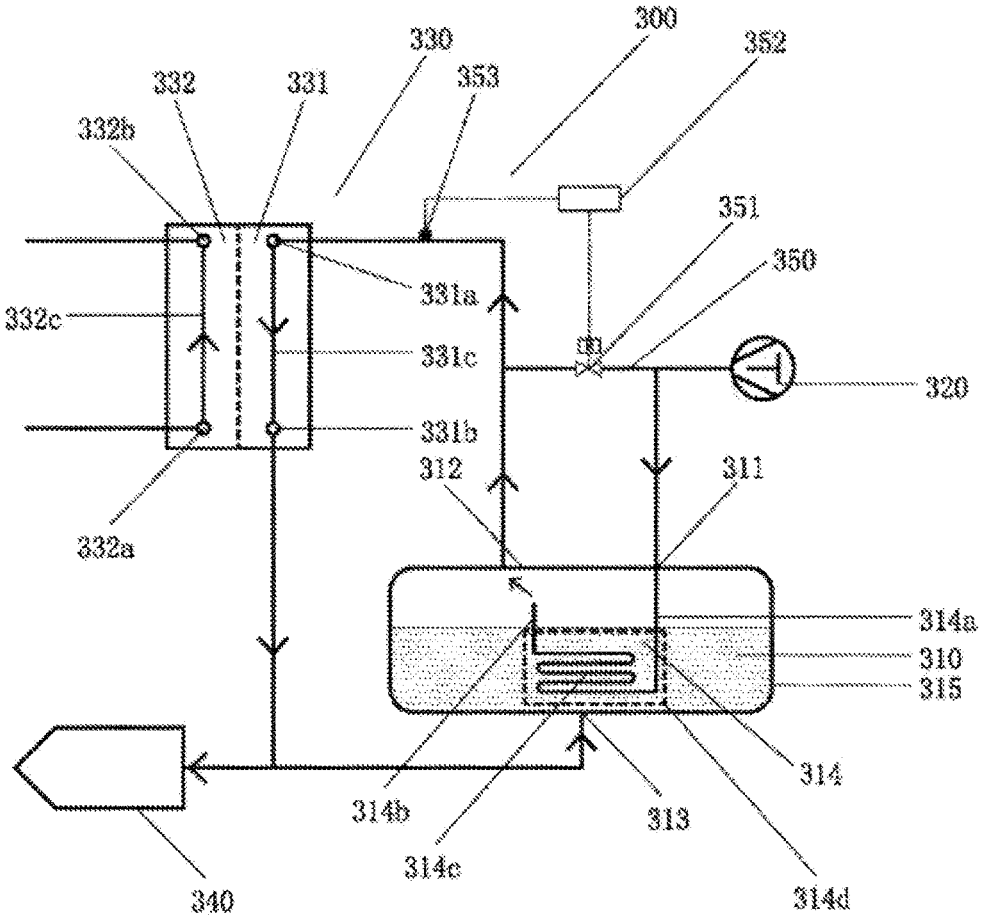
FIG. 3 is a schematic diagram of another embodiment of the cascade refrigeration system according to the present invention.

Referring to FIG. 3, it shows a cascade refrigeration system 300, which has a main loop arrangement similar to the cascade refrigeration system 200 in the above embodiment. In addition, the cascade refrigeration system 300 is further provided with a bypass branch 350 that is connected from an outlet end of a compressor 320 to an inlet end 331*a* of a condensation part 331 of an evaporative condenser 330, and the bypass branch 350 is provided with a bypass valve 351 for controlling on/off thereof. With such an arrangement, on the premise that a high-temperature gaseous refrigerant from the compressor has been sufficiently cooled, the bypass branch 350 may be turned on via the bypass valve 351, so that part of the gaseous refrigerant directly gets to the inlet end 331*a* of the condensation part 331 of the evaporative condenser 330, and enters the condensation part 331 after being mixed with a refrigerant from a liquid accumulator here, thus making sure that the current refrigeration system runs according to a predetermined parameter.

Optionally, a temperature sensor 353 close to the inlet end 331*a* of the condensation part 331 of the evaporative condenser 330, and a controller 352 that is electrically connected to the temperature sensor 353 and the bypass valve 351 respectively may further be arranged. The controller 352 will control opening/closing of the bypass valve 351 in response to a temperature detected by the temperature sensor 353. In this implementation, a control parameter for controlling the refrigeration system and a correspondingly configured detection element and control element are further provided. The objective of stable running of the system is achieved by detecting, adjusting and controlling the refrigerant temperature at the inlet end 331*a* of the condensation part 331 of the evaporative condenser 330.

Optionally, in order to further refine the control, the bypass valve 351 may further be set as an opening degree-adjustable valve, and the controller 352 will control an opening degree of the bypass valve 351 in response to the temperature detected by the temperature sensor 353. Because the detection and sensing of the temperature sensor have a certain delay, and the whole system is generally in a continuous running state, by replacing the simple opening/closing control with adjustment on the opening degree of the bypass valve 351, the entire control will be steadier.

As a preferred example, when the cascade refrigeration system works, it is expected to maintain a temperature difference between the refrigerant in the evaporation part 332 of the evaporative condenser 330 and the refrigerant in the condensation part 331 at 6 K to 10 K. This helps maintain the service life of the evaporative condenser on one hand, and on the other hand, also avoids the cost problem caused by that the heat exchange area needs to be increased as the temperature difference is further decreased.

In a conventional running process of the cascade refrigeration system, after being throttled and supplying cool in the user terminal 340, a low-temperature liquid refrigerant will return to the compressor 320; the compressed refrigerant enters a main body part 314*c* of a cooling heat exchanger via an air inlet 311 of a liquid accumulator 310 and an inlet end 314*a* of the cooling heat exchanger, and during flowing, exchanges heat with the low-temperature liquid refrigerant surrounding the main body part 314*c*, to be sufficiently cooled; the cooled refrigerant flows out via an outlet end 314*b* of the cooling heat exchanger and an air outlet 312 of the liquid accumulator 310, and flows into a heat exchange section 331*c* of the condensation part via the inlet end 331*a* of the condensation part 331 of the evaporative condenser 330; a medium-temperature liquid refrigerant therein will exchange heat with the low-temperature liquid refrigerant in the evaporation part 332 of the evaporative condenser 330, to be further cooled. The cooled refrigerant will flow out from an outlet end 331*b* of the condensation part. Most of the refrigerant will flow into the user terminal 340 again, to be throttled and to supply cool; meanwhile, the other part of the liquid refrigerant will return to and accumulate in the liquid accumulator 310, thus preliminarily cooling a high-temperature gaseous refrigerant that enters the liquid accumulator 310 via the compressor 320. In this process, the liquid accumulator 310 undertakes most part of cooling for the high-temperature gaseous refrigerant from the compressor 320, and in this way, the downstream evaporative condenser 330 only needs to bear less and stable condensation load, which greatly mitigates the fatigue use of the evaporative condenser 330, and improves the service life of the equipment while guaranteeing the system performance.

In the foregoing conventional running process, the high-temperature gaseous refrigerant from the compressor 320 may be excessively cooled in the liquid accumulator 310, and this will cause the refrigerant to have a temperature lower than a desired temperature when entering the evaporative condenser 330, and will also cause the temperature difference between the refrigerants in the condensation part 331 and the evaporation part 332 of the evaporative condenser 330 to be lower than a desired value. As a smaller temperature difference generally requires a larger contact area to implement equivalent heat exchange, and specifications such as a heat exchange contact area of the evaporative condenser in running are already determined, this case is adverse to the heat exchange between the two. Therefore, it is necessary to adjust and control the temperature of the refrigerant entering the condensation part 331, to restore the temperature to an expected level. In this case, the bypass branch 350 may be selectively turned on, to allow part of the high-temperature gaseous refrigerant to directly get from the compressor 320 to the inlet end 331*a* of the condensation part 331, to neutralize the refrigerant from the liquid accumulator 310, thus obtaining a desired refrigerant of an expected working condition.

Although the embodiments described above with reference to the accompanying drawings are all applied to the cascade refrigeration system, persons skilled in the art should know that, when there is a similar technical problem in a general heat exchange system, the problem may also be solved by using such a structural design and connection manner. The application of a liquid accumulator in an embodiment of the present invention to a general refrigeration system is simply described below.

This type of refrigeration system should also include any embodiment of the liquid accumulator described above; and a compressor, a condenser, a throttling element, and an evaporator that are sequentially connected through a pipeline, where an outlet end of the compressor is connected to an air inlet of the liquid accumulator, and is connected to an inlet end of the condenser through an air outlet of the liquid accumulator, while an outlet end of the condenser is separately connected to the throttling element and an liquid inlet of the liquid accumulator. Further, in order to enhance control of this type of system, supporting detection and control elements may also be disposed. For example, the system may further include: a bypass branch connected from the outlet end of the compressor to the inlet end of the condenser, and the bypass branch is provided with a bypass valve for controlling on/off thereof; a temperature sensor arranged close to the inlet end of the condenser; and a controller electrically connected to the temperature sensor and the bypass valve respectively. The controller controls opening/closing of the bypass valve in response to a temperature detected by the temperature sensor. Similar to that as mentioned above, the control process thereof may also be refined. For example, the bypass valve is an opening degree-adjustable valve, and the controller controls an opening degree of the bypass valve in response to the temperature detected by the temperature sensor. The running process and adjustment process of the general refrigeration system are also similar to those in the above embodiment, and therefore are not described in detail herein again.

For the cascade refrigeration system provided with the bypass branch 350 and the corresponding detection, adjustment and control components and parts in the above embodiment, the present invention further provides several embodiments of a system control method herein.

As an optional solution, in the method, a desired working temperature of a refrigerant at the inlet end of the condensation part of the evaporative condenser is preset as a first threshold. In this case, the method includes: closing the bypass valve on the bypass branch when the temperature detected by the temperature sensor is not lower than the first threshold; or opening the bypass valve on the bypass branch when the detected temperature is lower than the first threshold, so that the whole refrigeration system runs according to a desired working state as far as possible.

As another optional solution, in the method, a desired working temperature of a refrigerant at the inlet end of the condensation part of the evaporative condenser is also preset as a first threshold. However, in this method, an opening degree-adjustable valve will be used as the bypass valve disposed on the bypass branch. In this case, the method is further refined as: reducing the opening degree of the bypass valve on the bypass branch when the temperature detected by the temperature sensor is not lower than the first threshold, wherein a change in the opening degree of the bypass valve is linearly correlated to a difference between the detected temperature and the first threshold; or increasing the opening degree of the bypass valve on the bypass branch when the detected temperature is lower than the first threshold, wherein a change in the opening degree of the bypass valve is linearly correlated to a difference between the detected temperature and the first threshold. This will not only make the whole refrigeration system run according to a desired working state as far as possible but also make the whole adjustment process smoother and improve the stability.

In the description of the present invention, it should be understood that direction or position relations indicated by "upper", "lower", "front", "rear", "left", "right" and the like are direction or position relations based on the figures, are merely used to facilitate the description of the present invention and to simplify the description rather than indicating or implying that the indicated device or feature must have the specific direction or be constructed and operated in the specific direction, and therefore cannot be construed as a limitation to the present invention.

The above examples mainly describe the liquid accumulator, the refrigeration system having the same, and the control method thereof according to the present invention. Although only some implementations of the present invention are described, persons of ordinary skill in the art should understand that the present invention may be implemented in many other manners without departing from the purport and scope of the present invention. Therefore, the illustrated examples and implementations are regarded as illustrative rather than limitative, and the present invention may cover various modifications and replacements without departing from the spirit and scope of the present invention as defined in the appended claims.

The invention claimed is:

1. A refrigeration system, comprising:

a liquid accumulator including:

a liquid accumulator housing provided with an air inlet, an air outlet, and a liquid inlet and a cooling heat exchanger disposed in the liquid accumulator housing;

wherein the cooling heat exchanger comprises an inlet end, a main body part, and an outlet end in sequence; the inlet end of the cooling heat exchanger is connected to the air inlet on the liquid accumulator housing; and the outlet end of the cooling heat exchanger is arranged to be higher than a working liquid level of a refrigerant in the liquid accumulator; and a compressor, a condenser, a throttling element, and an evaporator that are sequentially connected through a pipeline, wherein an outlet end of the compressor is connected to the air inlet of the liquid accumulator, wherein the outlet end of the compressor is connected to an inlet end of the condenser through the air outlet of the liquid accumulator, and an outlet end of the condenser is separately connected to the throttling element and the liquid inlet of the liquid accumulator.

2. The refrigeration system according to claim 1, wherein when the liquid accumulator works, the main body part is at least partially submerged in the refrigerant in the liquid accumulator.

3. The refrigeration system according to claim 2, wherein when the liquid accumulator works, the main body part is completely submerged in the refrigerant in the liquid accumulator.

4. The refrigeration system according to claim 1, wherein the main body part is at least partially arranged below a first height of the liquid accumulator; or at least partially arranged below a height corresponding to a first volume of the liquid accumulator, wherein when the liquid accumulator works, the refrigerant in the liquid accumulator is located at the first height or in the first volume.

5. The refrigeration system according to claim 4, wherein the main body part is completely arranged below the first height of the liquid accumulator; or completely arranged below the height corresponding to the first volume of the liquid accumulator.

6. The refrigeration system according to claim 4, wherein the first height is half of a total height of the liquid accumulator; or the first volume is half of a total volume of the liquid accumulator.

7. The refrigeration system according to claim 1, wherein the main body part is a coiled tube heat exchanger circling in an encircling form or a finned heat exchanger in reciprocating arrangement.

8. The refrigeration system according to claim 7, wherein the main body part is connected to the bottom of the liquid accumulator housing through an end plate.

9. The refrigeration system according to claim 1, wherein the cooling heat exchanger further comprises a heat exchanger housing, and the main body part is arranged in the heat exchanger housing.

10. The refrigeration system according to claim 9, wherein the heat exchanger housing is welded to an inner wall of the bottom of the liquid accumulator housing.

11. The refrigeration system according to claim 10, wherein the heat exchanger housing and the liquid inlet on the liquid accumulator housing are arranged in a staggered manner.

12. The refrigeration system according to claim 1, wherein the air inlet and/or the air outlet are/is arranged at the top of the liquid accumulator housing.

13. The refrigeration system according to claim 1, wherein the liquid inlet is arranged at the bottom of the liquid accumulator housing.

14. The refrigeration system according to claim 1, wherein the liquid inlet is arranged at a first position at the bottom of the liquid accumulator housing, wherein when the liquid accumulator works, the first position is located at a lowest position at the bottom of the liquid accumulator housing.

15. The refrigeration system according to claim 1, further comprising: a bypass branch connected from the outlet end of the compressor to the inlet end of the condenser, wherein the bypass branch is provided with a bypass valve for controlling on/off thereof.

16. The refrigeration system according to claim 15, further comprising: a temperature sensor arranged close to the inlet end of the condenser; and a controller electrically connected to the temperature sensor and the bypass valve respectively, wherein the controller controls opening/closing of the bypass valve in response to a temperature detected by the temperature sensor.

17. The refrigeration system according to claim 16, wherein the bypass valve is an opening degree-adjustable valve, and the controller controls an opening degree of the bypass valve in response to the temperature detected by the temperature sensor.

18. A cascade refrigeration system, comprising:

a liquid accumulator including:

a liquid accumulator housing provided with an air inlet, an air outlet, and a liquid inlet; and a cooling heat exchanger disposed in the liquid accumulator housing;

wherein the cooling heat exchanger comprises an inlet end, a main body part, and an outlet end in sequence; the inlet end of the cooling heat exchanger is connected to the air inlet on the liquid accumulator housing; and the outlet end of the cooling heat exchanger is arranged to be higher than a working liquid level of a refrigerant in the liquid accumulator; and a compressor, an evaporative condenser having an evaporation part and a condensation part that exchange heat with each other, a throttling element, and an evaporator that are sequentially connected through a pipeline, wherein an outlet end of the compressor is connected to the air inlet of the liquid accumulator, wherein the outlet end of the compressor is connected to an inlet end of the condensation part of the evaporative condenser through the air outlet of the liquid accumulator, and an outlet end of the condensation part of the evaporative condenser is separately connected to the throttling element and the liquid inlet of the liquid accumulator.

19. The cascade refrigeration system according to claim 18, further comprising: a bypass branch connected from the outlet end of the compressor to the inlet end of the condensation part of the evaporative condenser, wherein the bypass branch is provided with a bypass valve for controlling on/off thereof.

20. The cascade refrigeration system according to claim 19, further comprising: a temperature sensor arranged close to the inlet end of the condensation part of the evaporative condenser; and a controller electrically connected to the temperature sensor and the bypass valve respectively, wherein the controller controls opening/closing of the bypass valve in response to a temperature detected by the temperature sensor.

21. The cascade refrigeration system according to claim 20, wherein the bypass valve is an opening degree-adjustable valve, and the controller controls an opening degree of the bypass valve in response to the temperature detected by the temperature sensor.

22. The cascade refrigeration system according to claim 18, wherein when the cascade refrigeration system works, a temperature difference between a refrigerant in the evaporation part of the evaporative condenser and a refrigerant in the condensation part is 6 K to 10 K.

23. A control method of a cascade refrigeration system, wherein the refrigeration system according to claim 20 is comprised, and a desired working temperature of a refrigerant at the inlet end of the condensation part of the evaporative condenser is preset as a first threshold, the method comprising:

closing the bypass valve on the bypass branch when the temperature detected by the temperature sensor is not lower than the first threshold; or opening the bypass valve on the bypass branch when the detected temperature is lower than the first threshold.

24. A control method of a cascade refrigeration system, wherein the refrigeration system according to claim 21 is comprised, and a desired working temperature of a refrigerant at the inlet end of the condensation part of the evaporative condenser is preset as a first threshold, the method comprising:

reducing the opening degree of the bypass valve on the bypass branch when the temperature detected by the temperature sensor is not lower than the first threshold, wherein a change in the opening degree of the bypass valve is linearly correlated to a difference between the detected temperature and the first threshold; or increasing the opening degree of the bypass valve on the bypass branch when the detected temperature is lower than the first threshold, wherein a change in the opening degree of the bypass valve is linearly correlated to a difference between the detected temperature and the first threshold.

* * * * *